US005381769A

United States Patent [19]

Nishigaki et al.

[11] Patent Number: 5,381,769

[45] Date of Patent: Jan. 17, 1995

[54] THROTTLE VALVE DRIVE APPARATUS

[75] Inventors: Kazuhiro Nishigaki, Gifu; Hitoshi Tasaka, Chiryu, both of Japan

[73] Assignee: Nippondenso Co., Ltd., Kariya, Japan

[21] Appl. No.: 52,540

[22] Filed: Apr. 29, 1993

[30] Foreign Application Priority Data

Apr. 30, 1992 [JP] Japan ..... 4-111687
Apr. 16, 1993 [JP] Japan ..... 5-089780

[51] Int. Cl.[6] ..... F02D 9/02
[52] U.S. Cl. ..... 123/399
[58] Field of Search ..... 123/396, 399, 400

[56] References Cited

U.S. PATENT DOCUMENTS

| | | | |
|---|---|---|---|
| 4,961,355 | 10/1990 | Irino et al. | 123/399 |
| 5,002,032 | 3/1991 | Kolberg | 123/399 |
| 5,027,766 | 7/1991 | Zentgraf et al. | 123/399 |
| 5,048,485 | 9/1991 | Terazawa et al. | 123/399 |
| 5,074,266 | 12/1991 | Kuhn et al. | 123/399 |
| 5,131,364 | 7/1992 | Mann | 123/399 |
| 5,141,070 | 8/1992 | Hickmann et al. | 123/396 |
| 5,148,787 | 9/1992 | Ganser | 123/399 |
| 5,168,850 | 12/1992 | Zentgraf et al. | 123/399 |
| 5,168,951 | 12/1991 | Sugiura et al. | 123/399 |
| 5,265,572 | 11/1993 | Kadomukai et al. | 123/396 |
| 5,269,273 | 12/1993 | Yasuda et al. | 123/399 |

FOREIGN PATENT DOCUMENTS

| | | |
|---|---|---|
| 58-20948 | 2/1983 | Japan . |
| 60-180735 | 11/1985 | Japan . |
| 1301934 | 12/1989 | Japan . |

*Primary Examiner*—Raymond A. Nelli
*Assistant Examiner*—Thonas N. Moulis
*Attorney, Agent, or Firm*—Cushman, Darby & Cushman

[57] ABSTRACT

A throttle valve drive apparatus comprises an actuator which serves to mechanically drive a throttle valve disposed in an intake passage of an internal combustion engine and is controlled in accordance with an instruction from a control unit, an accelerator lever which serves to mechanically drive the throttle valve and to adjust the opening degree of the throttle valve in accordance with an amount of operation performed by an operator, a first clutch disposed between rotary shafts of the actuator and the throttle valve and serving to transmit a turning force from the actuator to the throttle valve, and a second clutch disposed between rotary shafts of the accelerator lever and the throttle valve and serving to transmit the turning force from the accelerator lever to the throttle valve. In this apparatus, an engaging force of the first clutch is discriminated from that of the second clutch, one of the first and second clutches has a greater engaging force comprising an on-off constant engagement type clutch, the other clutch having a smaller engaging force comprising a constant engagement type clutch, and the on-off type clutch is switched on and off so as to transmit the turning force to the throttle valve selectively from the actuator or the accelerator lever.

16 Claims, 5 Drawing Sheets

THROTTLE VALVE DRIVE APPARATUS

BACKGROUND OF THE INVENTION

1. Field of the Invention

The present invention relates to a throttle valve drive apparatus which serves to control the opening of a throttle valve disposed in an intake passage of an internal combustion engine, and more particularly, to an apparatus which is capable of driving the throttle valve selectively by means of both an accelerator lever operated by an operator and an electronic control unit.

2. Description of the Prior Art

Hitherto, as a throttle valve controlling apparatus which serves to regulate the flow of intake air to an internal combustion engine, one that is capable of adjusting the opening of a throttle valve by both an accelerator operation system operated by an operator and an electric operation system driven by a control unit has been known as disclosed in Japanese Patent Unexamined Publication No. 58-20948 and Japanese Utility Model Unexamined Publication No. 60-180735.

This kind of apparatus comprises an actuator-side clutch by means of which an actuator of an electric operation system and a throttle valve are mechanically connected and disconnected and an accelerator-side clutch by means of which an accelerator lever and the throttle valve are mechanically connected and disconnected, and both clutches are controlled by an electronic control unit (ECU). In ordinary running, the actuator-side clutch is switched on (connected) and the accelerator lever-side clutch is switched off (disconnected) so that the throttle valve is driven by the actuator. On the other hand, in case of a trouble, e.g., when it becomes impossible to control the actuator, the actuator side clutch is switched off and the accelerator lever-side clutch is switched on so as to drive the throttle valve by means of the accelerator lever.

However, according to the aforesaid electronic throttle controlling apparatus disclosed in Japanese Patent Unexamined Publication No. 58-20948 or Japanese Utility Model Unexamined Publication No. 60-180735, since the on-off control of the two electromagnetic clutches are effected in accordance with instructions from the control unit, the number of arithmetic processes of the control unit is increased and complicate the control, with the result being that malfunction occurs easily. Further, if the two electromagnetic clutches are simultaneously controlled to be switched on and off, a noise produced at the time of the connection of the electromagnetic clutch becomes audible to a driver of a vehicle, thus giving rise to a problem that the vehicle makes noises while running.

SUMMARY OF THE INVENTION

To solve the problems described above, an object of the present invention is to provide a throttle control apparatus in which only one of the clutches of an internal combustion engine including an actuator-side clutch and an accelerator lever-side clutch is an on-off clutch, so that the number of arithmetic processes of a control unit can be reduced and the opening of a throttle valve can be controlled due to connection of the accelerator lever-side clutch in case of a trouble.

To achieve this end, there is provided according to the present invention a throttle valve drive apparatus which comprises an actuator which serves to mechanically drive a throttle valve disposed in an intake passage of an internal combustion engine which is controlled in accordance with an instruction from a control unit, an accelerator lever which serves to mechanically drive the throttle valve and to adjust the opening of the throttle valve in accordance with an amount of operation performed by an operator, a first clutch disposed between rotary shafts of the actuator and the throttle valve and serving to transmit turning force from the actuator to the throttle valve, and a second clutch disposed between rotary shafts of the accelerator lever and the throttle valve and serving to transmit turning force from the accelerator lever to the throttle valve, and in which an engaging force of the first clutch is discriminated from that of the second clutch, one of the first and second clutches has a greater engaging force comprising an on-off type clutch, the other clutch having a smaller engaging force comprising a constant engagement type clutch, and the on-off type clutch is switched on or off so as to transmit the turning force to the throttle valve selectively from the actuator or the accelerator lever.

According to the construction of the present invention, only one of the first clutch on the side of the electric operation system (actuator) and the second clutch on the side of the mechanical operation system (accelerator lever) is an on-off type clutch and the clutch having the smaller engaging force is a constant engagement type clutch such as a friction clutch, so that the electric operation system and the mechanical operation system are changed over by switching on and off the clutch having the greater engaging force. Therefore, since the control unit performs the on-off control of one of the clutches, the control is simplified, with the result being that the number of arithmetic processes of the electronic control unit is reduced.

DESCRIPTION OF THE PREFERRED EMBODIMENTS

Description will be given below of preferred embodiments of the present invention with reference to the drawings.

FIGS. 1 to 5 show a first embodiment of the present invention applied to a throttle controlling apparatus of an internal combustion engine. It is noted that, in the embodiments to be described hereinafter, the slip ratios (liabilities to slip) of two friction type clutches are discriminated from each other so as to make a difference in the engaging force of the two clutches.

Figure 1:
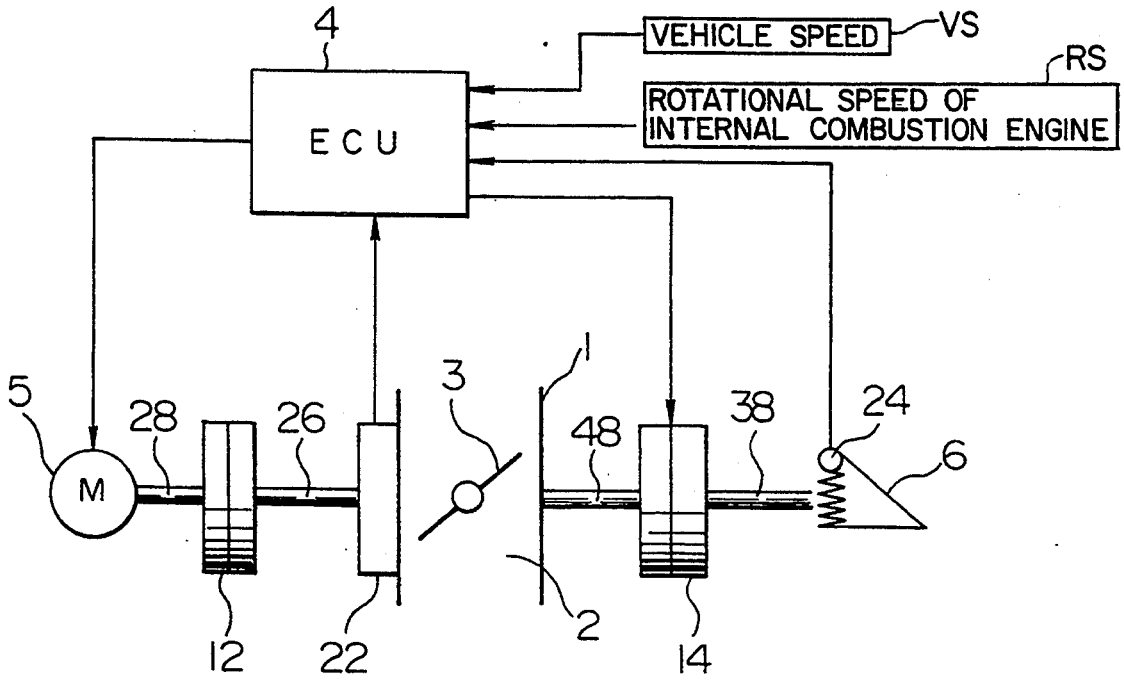
FIG. 1 is a schematic system view for illustrating a first embodiment of the present invention.

As shown in FIG. 1, in the throttle valve controlling apparatus of the internal combustion engine, a throttle valve 3 is disposed in an intake passage 2 formed in a throttle body 1. Means for driving the throttle valve 3 comprises an electric operation system and an accelerator operation system. The electric operation system serves to drive the throttle valve 3 by means of a motor 5 which serves as an actuator and is controlled in accordance with an instruction from an electronic control unit (ECU) 4, while the accelerator operation system serves to drive the throttle valve 3 due to the operation of an accelerator lever 6. The ECU 4 receives signals indicating the vehicle speed VS and the rotational speed of the internal combustion engine RS.

The throttle valve 3 and the motor 5 are connected and disconnected by means of an actuator-side clutch 12 serving as a first clutch, while the throttle valve 3 and the accelerator lever 6 are connected and disconnected by means of an accelerator-side clutch 14 serving as a second clutch.

To the ECU 4 are applied not only a throttle opening degree signal detected by a throttle opening degree sensor 22 and an accelerator opening degree signal detected by an accelerator opening degree sensor 24 which serves to detect the opening degree of the accelerator lever 6 but also a signal indicative of the rotational speed of the internal combustion engine, a signal indicative of the vehicle speed and the like. Based on these signals, the running condition of the vehicle is judged. As a result of the judgement, a signal for opening the throttle valve is sent to the motor 5 and an on-off signal is sent to the accelerator-side clutch 14.

Figure 2:
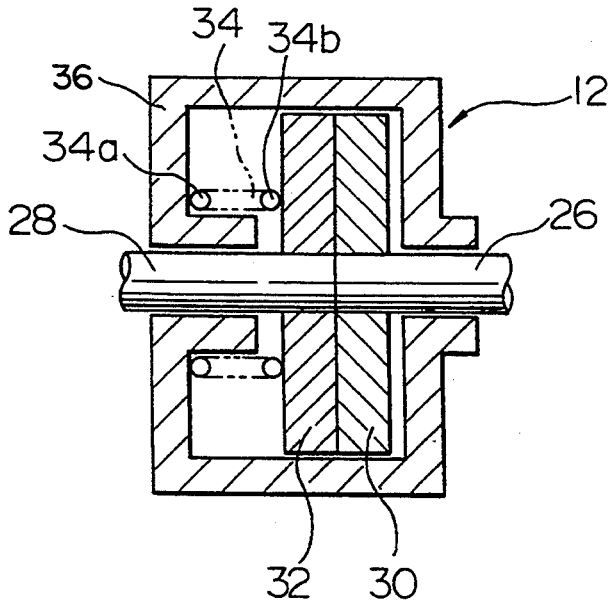
FIG. 2 is a schematic sectional view for illustrating an actuator-side clutch of the first embodiment.

FIG. 2 shows the concrete structure of the actuator-side clutch 12 in which a connecting member 30 fixed to an end of a valve shaft 26 of the throttle valve 3 is opposite to a connecting member 32 fixed to an end of a shaft 28 connected to the motor 5 shown in FIG. 1. A compression coiled spring 34 is brought into contact with a housing 36 at one end 34*a* thereof and with the connecting member 32 at the other end 34*b* thereof. By so doing, the shaft 28 of the motor 5 and the shaft 26 of the throttle valve 3 are kept in engagement with each other constantly by means of the connecting members 30 and 32.

Figure 3:
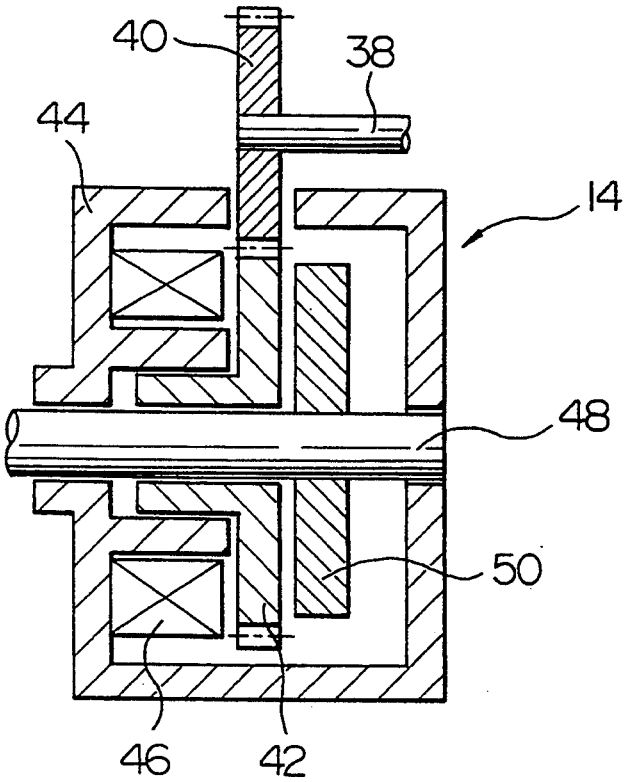
FIG. 3 is a schematic sectional view for illustrating an accelerator-side clutch of the first embodiment.

FIG. 3 shows the structure of the accelerator-side clutch 14 in which a gear 42 meshing with a gear 40 fixed to .one end of a shaft 38 connected with the accelerator lever 6 shown in FIG. 1 is received in a housing 44. Within the housing 44 is disposed a coil 46 which is to be energized when an electric current is passed. A connecting member 50 fixed to a valve shaft 48 of the throttle valve 3 is capable of being connected to the gear 42 due to the energization of the coil 46. When the coil 46 is turned off, the gear 42 and the connecting member 50 are disconnected as shown in FIG. 3, while, when the coil 46 is turned on, the gear 42 and the connecting member 50 are connected due to the electromagnetic attraction. Incidentally, the coil 46 is turned on and off in accordance with instruction from the ECU 4 shown in FIG. 1.

Next, description will be given of the relation between the turning torque and the slip ratio of the actuator-side clutch 12 and the accelerator-side clutch 14 of the present embodiment with reference to FIG. 4.

Figure 4:
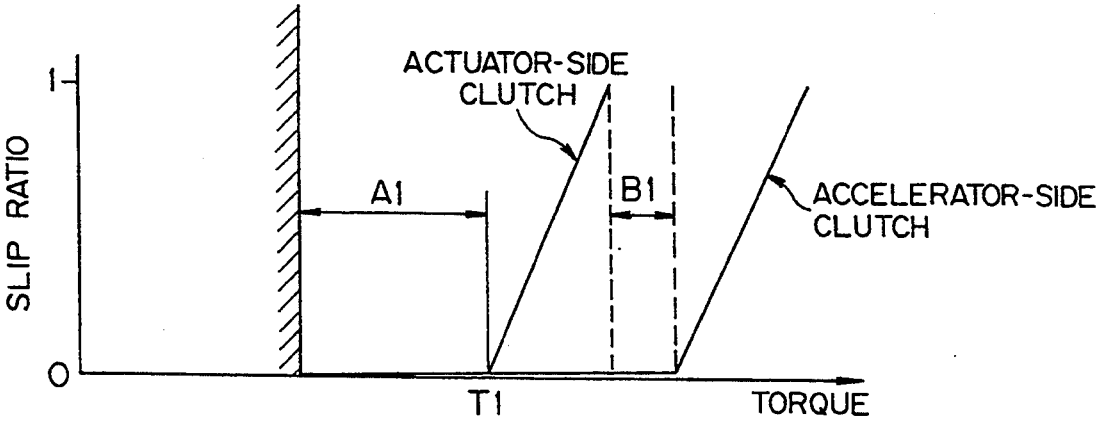
FIG. 4 is a characteristic view for illustrating the relation between the slip ratio of the actuator-side clutch and that of the accelerator-side clutch in the first embodiment.

Concerning the actuator-side clutch 12 shown in FIG. 4, as the turning torque exceeds a predetermined value $T_1$, slip occurs between the connecting member 32 and the connecting member 30 shown in FIG. 2. The predetermined value $T_1$ is a characteristic value which depends on the set force of the compression coiled spring 34 and the like, so that it cannot be controlled by the electric signal. The actuator-side clutch 12 is capable of transmitting the torque to the throttle valve 3 in a torque range A1 shown in FIG. 4. The lower limit LL of the torque range A1 is greater than the set torque given by a return spring for biasing the throttle valve 3 in the closing direction.

On the other hand, the accelerator-side clutch 14 is operated in accordance with an electric control signal sent from the ECU 4 so as to make the on-off control for the connection and disconnection of the accelerator lever 6 and the throttle valve 3. As shown in FIG. 4, the accelerator-side clutch 14 is capable of transmitting the torque to the throttle valve 3 in a range B1. In the range B1, slip occurs in the actuator-side clutch 12. Namely, if the throttle valve 3 is driven by the torque within the range B1 after the connection of the accelerator-side clutch 14, transmission of the driving torque of the motor 5 performed through the actuator-side clutch 12 is interrupted, so that the opening of the throttle valve 3 can be controlled by the accelerator lever 6.

Figure 5:
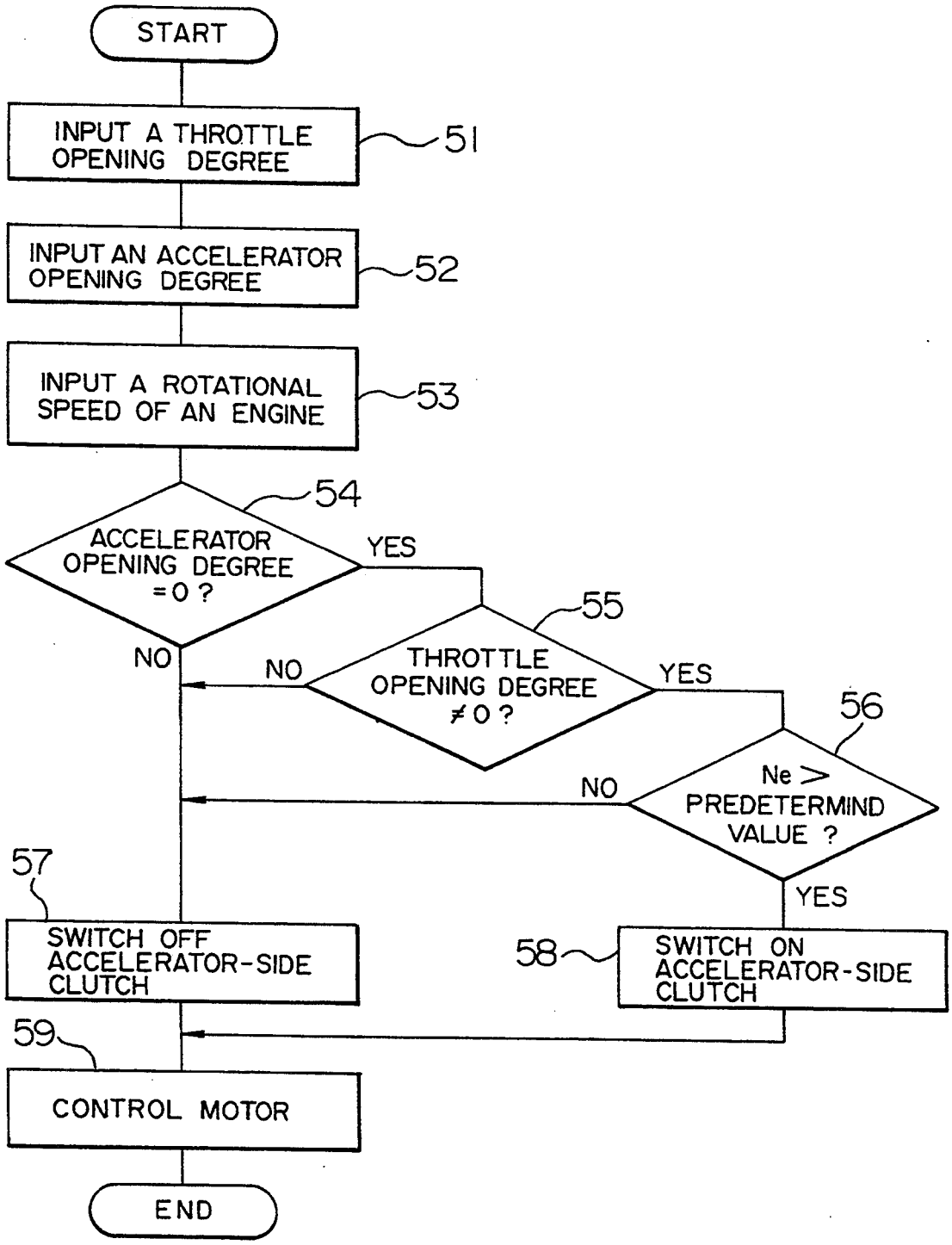
FIG. 5 is a flow chart for illustrating the flow of the control effected in the first embodiment.

Next, a method for controlling the accelerator-side clutch 14 by the ECU 4 will be described in accordance with a flow chart shown in FIG. 5.

First, at steps 51, 52 and 53, signals indicative of the throttle opening degree, the accelerator opening degree and the rotational speed of the internal combustion engine are fed to the ECU 4 so as to judge, based on these signals, whether or not the system has failed. At steps 54, 55 and 56, in case that three conditions are satisfied, that is, the accelerator is fully closed, the throttle is not fully closed and the rotational speed Ne of the internal combustion engine exceeds a predetermined value, for example, an idling rotational speed, it is judged to be failed, while in any other case, it is judged to be in the ordinary running condition.

In the ordinary running condition, the accelerator-side clutch 14 is turned off as shown at step 57. At this time, the actuator-side clutch 12 is in a state of connection. And, the motor 5 is controlled as shown at step 59.

In the failed state, the accelerator-side clutch 14 is switched on at step 58. In this case, although the motor 5 is controlled, the opening degree of the throttle valve 3 is adjusted by the accelerator lever 6 since the actuator-side clutch 12 slips.

Description will be given of the aforesaid torque transmitted to the throttle valve 3. In the ordinary running condition, a torque within the range A1 is transmitted from the motor 5 to the throttle valve 3 through the actuator-side clutch 12 as shown in FIG. 4. In the failed state, a torque within the range B1 is transmitted from the accelerator lever 6 to the throttle valve 3 through the accelerator-side clutch 14.

In such failed state, though the actuator-side clutch 12 is kept in the engaged state constantly, slip occurs between the connecting member 32 and the connecting member 30 shown in FIG. 2. At this time, as shown in FIG. 5, at step 59 effected by the ECU 4, the motor 5 is controlled by the ECU 4 even in the failed state. The reason for this is that, by performing the on-off switch of the accelerator-side clutch 14 as in the ordinary running without changing the control of the motor 5 by the ECU 4, the control is simplified to thereby prevent any malfunction. Incidentally, according to the present invention, it is also possible to stop the control of the motor 5 by the ECU 4 when the accelerator-side clutch 14 is switched on. Further, in case that it becomes impossible to control the throttle valve by means of the motor 5, by mechanically connecting the accelerator lever and the actuator through the clutch, the throttle valve can be controlled so as to insure safety.

Figure 6:
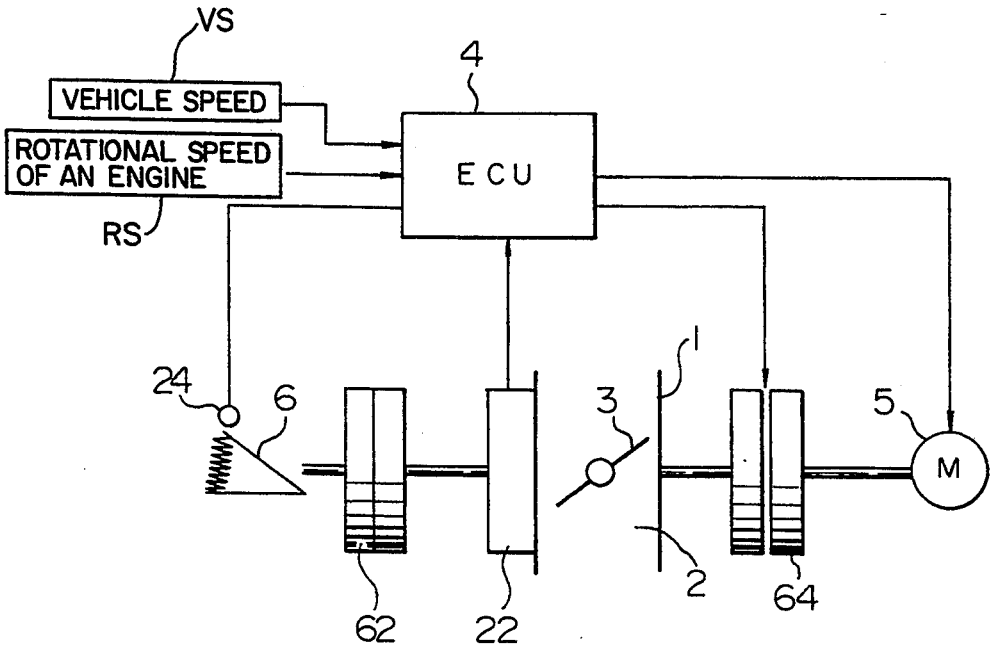
FIG. 6 is a schematic system view for illustrating a second embodiment.

FIG. 6 shows a second embodiment of the present invention.

Figure 7:
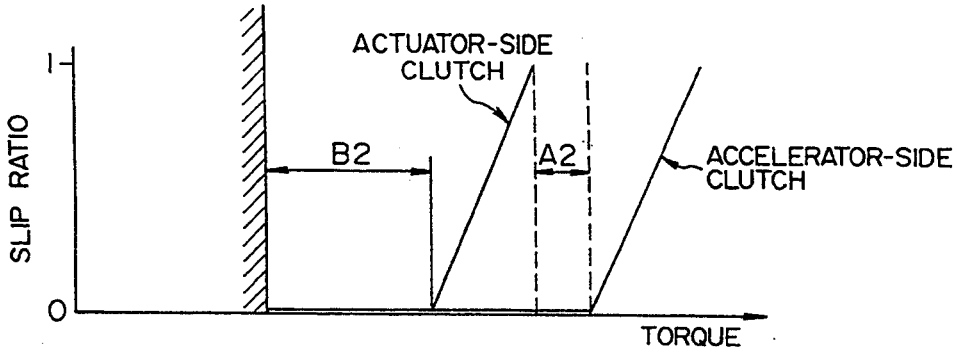
FIG. 7 is a characteristic view for illustrating the relation between the slip ratio of the actuator-side clutch and that of the accelerator-side clutch in the second embodiment.

In the second embodiment shown in FIG. 6, the accelerator lever 6 and the throttle valve 3 are kept in mechanical engagement with each other constantly by means of an accelerator-side clutch 62 having a greater slip ratio. On the other hand, an actuator-side clutch 64 having a smaller slip ratio is switched between connected and disconnected states in accordance with a control signal from the ECU 4. FIG. 7 shows the relation between the turning torque and the slip ratio of the actuator-side clutch 64 and the accelerator-side clutch 62.

In the ordinary running, both the actuator-side clutch 64 and the accelerator-side clutch 62 are switched on, so that the driving force of the motor 5 is transmitted due to a difference in the ratio of slip occurring in the clutches so as to control the throttle valve 3. In the failed state, the ECU 4 detects the failed state and sends a control signal to the actuator-side clutch 64 so as to switch off the connection thereof. By so doing, the driving torque from the motor 5 is not transmitted to the throttle valve 3, so that the throttle valve 3 is controlled by the accelerator lever 6. Incidentally, as shown in FIG. 7, during the ordinary running, the turning torque of the throttle valve 3 is in a range A2, while in the failed state, the turning torque of the throttle valve 3 is in a range B2. The lower limit LL of the torque range A2 is greater than the set torque given by a return spring for biasing the throttle valve 3 in the closing direction.

In the second embodiment as well, since it is sufficient that only one of the electromagnetic clutches is controlled by the control unit, the control can be simplified.

Figure 8:
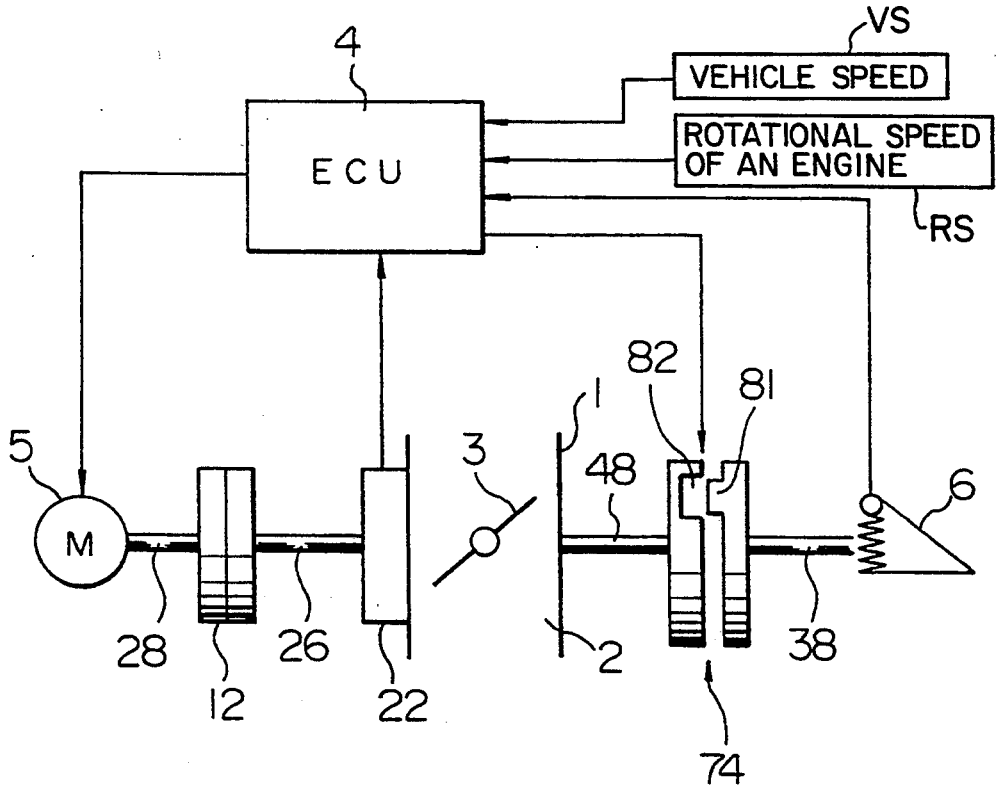
FIG. 8 is a schematic system view for illustrating a third embodiment.

FIG. 8 shows a third embodiment of the present invention.

In the third embodiment, in place of the accelerator-side clutch 14 of friction type of the first embodiment, there is employed an accelerator-side clutch 74 of dog engagement type in which a projection 81 fits into a hole 82 so as to make an engagement to transmit the rotation. Incidentally, the same portions as those of the first embodiment are denoted by the same reference numerals.

As shown in the third embodiment, the clutch that has a small slip ratio and a strong engaging force is not limited to the friction type clutch but may be the non-friction type clutch which uses a projection or pin for making the engagement. By employing the clutch of dog engagement type as shown in the third embodiment, in case of operating the throttle valve 3 by operating the accelerator lever 6, it is possible to surely connect the accelerator lever 6 and the throttle valve 3, so that the throttle valve 3 can be operated in accordance with the operation amount of the accelerator lever 6 while making the actuator-side clutch 12 slip without fail.

As has been described above, according to the throttle valve drive apparatus of the present invention, since the engaging force of the actuator-side clutch which serves to connect the actuator and the throttle valve is discriminated from that of the accelerator-side clutch which serves to connect the accelerator lever and the throttle valve, and since the clutch having the smaller engaging force is kept in the engaged state constantly, the number of arithmetic processes of the control unit is decreased, with the result being control is simplified.

Further, even when the control unit or the like breaks down, it is possible to adjust the opening degree of the throttle valve by operating the accelerator lever through the connection of the accelerator-side clutch, and therefore, the security can be insured.

What is claimed is:

1. A throttle valve drive apparatus in an internal combustion engine comprising:

a throttle valve disposed in an intake passage of said internal combustion engine;

an actuator which mechanically drives said throttle valve in accordance with an instruction from a control unit;

an accelerator lever which mechanically drives said throttle valve to adjust an opening degree of said throttle valve in accordance with an amount of operation performed by an operator;

a first clutch disposed between a rotary shaft of said actuator and a first rotary shaft of said throttle valve, said first clutch transmitting an actuator turning force from said actuator to said throttle valve; and a second clutch disposed between a rotary shaft of said accelerator lever and a second rotary shaft of said throttle valve, said second clutch transmitting an accelerator turning force from said accelerator lever to said throttle valve;

wherein an engaging force of said first clutch is discriminated from an engaging force of said second clutch; and wherein one of said first and second clutches has a smaller engaging force than said other clutch and comprises a constant engagement type clutch, said other clutch having a greater engaging force and comprising an on-off type clutch.

2. A throttle valve drive apparatus according to claim 1, wherein said clutch having said smaller engaging force comprises a friction type clutch.

3. A throttle valve drive apparatus according to claim 2, wherein said clutch having said greater engaging force comprises a friction type clutch.

4. A throttle valve drive apparatus according to claim 2, wherein said clutch having said greater engaging force comprises an engagement type clutch having engaging members.

5. A throttle valve drive apparatus according to any one of claims 1 to 4, wherein said engaging force of said second clutch is greater than that of said first clutch.

6. A throttle valve drive apparatus according to any one of claims 1 to 4, wherein said engaging force of said first clutch is greater than that of said second clutch.

7. A throttle valve controlling apparatus for controlling an internal combustion engine, comprising:

a throttle valve disposed in an intake passage of said internal combustion engine to regulate a flow of intake air;

an accelerator lever having an operation amount controlled by an operator of said internal combustion engine for controlling an output of said internal combustion engine;

an actuator having an operation amount which controls said output of said internal combustion engine;

an electric control which controls said operation amount of said actuator;

a first clutch of friction and constant contact type disposed between said actuator and said throttle valve and transmitting said operation amount of said actuator to said throttle valve and permitting said actuator and said throttle valve to move relatively when a torque difference of not smaller than a predetermined value is caused between said actuator and said throttle valve; and a controllable second clutch disposed between said accelerator lever and said throttle valve, switchable between connected and disconnected states, and transmitting said operation amount of said accelerator lever to said throttle valve when in said connected state and permitting said accelerator lever and said throttle valve to move relatively when in said disconnected state.

8. A throttle valve controlling apparatus according to claim 7, wherein said first clutch comprises a friction clutch of constant contact type comprising:

a first rotary member to be rotated in accordance with said operation amount of said actuator;

a second rotary member to be rotated in accordance with said rotation amount of said throttle valve; and biasing means for bringing said first and second rotary members into contact with each other with a predetermined magnitude of force.

9. A throttle valve controlling apparatus according to claim 7, wherein said second clutch comprises a friction type clutch and permits, when a torque difference of not smaller than a second predetermined value is caused between said accelerator lever and said throttle valve, said accelerator lever and said throttle valve to move relatively even when in the connected state, said second predetermined value being larger than said predetermined value of said first clutch.

10. A throttle valve controlling apparatus according to claim 7, wherein said second clutch comprises a dog engagement type clutch and transmits said operation amount of said accelerator lever to said throttle valve through a projection when in an engaged state.

11. A throttle valve controlling apparatus according to claim 7, wherein said second clutch is switched between connected and disconnected states in accordance with an instruction signal from said control unit.

12. A throttle valve controlling apparatus for controlling an internal combustion engine, comprising:

a throttle valve disposed in an intake passage of said internal combustion engine to regulate a flow of intake air;

an accelerator lever having an operation amount controlled by an operator of said internal combustion engine for controlling an output of said internal combustion engine;

an actuator having an operation amount which controls said output of said internal combustion engine;

an electric control which controls said operation amount of said actuator;

a first clutch of friction and constant contact type disposed between said accelerator lever and said throttle valve and transmitting said operation amount of said accelerator lever to said throttle valve and permitting said accelerator lever and said throttle valve to move relatively when a torque difference of not smaller than a predetermined value is caused between said accelerator lever and said throttle valve; and a controllable second clutch disposed between said actuator and said throttle valve, switchable between connected and disconnected states, and transmitting said operation amount of said actuator to said throttle valve when in said connected state and permitting said actuator and said throttle valve to move relatively when in said disconnected state.

13. A throttle valve controlling apparatus according to claim 12, wherein said first clutch comprises a friction clutch of constant contact type comprising:

a first rotary member to be rotated in accordance with said operation amount of said accelerator lever;

a second rotary member to be rotated in accordance with said rotation amount of said throttle valve; and biasing means for bringing said first and second rotary members into contact with each other with a predetermined magnitude of force.

14. A throttle valve controlling apparatus according to claim 12, wherein said second clutch comprises a friction type clutch and permits, when a torque difference of not smaller than a second predetermined value is caused between said actuator and said throttle valve, said actuator and said throttle valve to move relatively even when in the connected state, said second predetermined value being larger than said predetermined value of said first clutch.

15. A throttle valve controlling apparatus according to claim 12, wherein said second clutch comprises a dog engagement type clutch and transmits said operation amount of said actuator to said throttle valve through a projection when in an engaged state.

16. A throttle valve controlling apparatus according to claim 12, wherein said second clutch is switched between connected and disconnected states in accordance with an instruction signal from said control unit.

* * * * *